US009566204B2

(12) United States Patent
Perri

(10) Patent No.: US 9,566,204 B2
(45) Date of Patent: Feb. 14, 2017

(54) SENTIMENTAL MEMORIES BOX FOR CASKETS

(71) Applicant: Monique Perri, Philadelphia, PA (US)

(72) Inventor: Monique Perri, Philadelphia, PA (US)

( * ) Notice: Subject to any disclaimer, the term of this patent is extended or adjusted under 35 U.S.C. 154(b) by 0 days.

(21) Appl. No.: 14/971,892

(22) Filed: Dec. 16, 2015

(65) Prior Publication Data

US 2016/0166457 A1 Jun. 16, 2016

Related U.S. Application Data

(60) Provisional application No. 62/092,490, filed on Dec. 16, 2014.

(51) Int. Cl.
*A61G 17/04* (2006.01)
*A61G 17/02* (2006.01)

(52) U.S. Cl.
CPC ..... *A61G 17/04* (2013.01); *A61G 17/02* (2013.01)

(58) Field of Classification Search
CPC ..... A61G 17/00; A61G 17/02; A61G 17/04; A61G 2017/045; A01G 5/04; A47B 91/00; A47F 3/00
USPC ..... 27/2, 14, 19; 47/41.12; 312/138.1, 351.3
See application file for complete search history.

(56) References Cited

U.S. PATENT DOCUMENTS 2,671,628 A * 3/1954 Everhard ..... A01G 5/00 248/151
5,611,124 A * 3/1997 Biondo ..... A61G 17/04 27/14
5,675,876 A * 10/1997 Benedict ..... A61G 17/04 27/1
5,727,291 A * 3/1998 Biondo ..... A61G 17/04 27/1
6,735,831 B1 * 5/2004 Greiwe ..... A61G 17/08 27/1
6,836,936 B1 * 1/2005 Biondo ..... A61G 17/04 27/14
6,898,830 B1 * 5/2005 Acton ..... A61G 17/00 27/1
7,320,162 B2 * 1/2008 Parker ..... A61G 17/04 27/16
7,392,574 B2 * 7/2008 Bovard ..... A61G 17/04 27/14
7,562,423 B2 * 7/2009 Pryd-Kakuk ..... A61G 17/08 27/1
7,908,720 B2 * 3/2011 Rojdev ..... A61G 17/04 27/10

(Continued)

*Primary Examiner* — William Miller
(74) *Attorney, Agent, or Firm* — Robert A. McKinley

(57) ABSTRACT

A display case for holding mementos having a pair of opposed ends, a pair of opposed sides, a bottom, and a top which defines the display case and forms an interior space within for holding the mementos, the top having an opening therein to permit access to the interior space. A cover is provided for selectively closing the top opening of the case. The bottom of the display case is configured to have a central indentation for accommodating an apex of a lid of a casket, a pair of rounded feet on each side of the indentation for providing a sturdy base upon which the display case sits on the lid, and a pair of stabilizing fins extending outwardly and downwardly to each side of the bottom of the display case to stabilize the display case on a curved or inclined top surface of the lid of the casket.

16 Claims, 4 Drawing Sheets

(56) References Cited

U.S. PATENT DOCUMENTS

| | | | | |
|---|---|---|---|---|
| 8,046,882 | B2 * | 11/2011 | Rojdev | A61G 17/00 27/10 |
| 8,523,118 | B2 * | 9/2013 | Weder | A01G 5/04 248/151 |
| 2004/0111961 | A1 * | 6/2004 | Cooper | A01G 5/04 47/41.12 |
| 2005/0204525 | A1 * | 9/2005 | Wray | A61G 17/04 27/20 |
| 2006/0048353 | A1 * | 3/2006 | Brinneman | A61G 17/04 27/2 |
| 2009/0030804 | A1 * | 1/2009 | Sell | A61G 17/00 705/26.5 |
| 2009/0282657 | A1 * | 11/2009 | Parker | A61G 17/00 27/2 |

* cited by examiner

SENTIMENTAL MEMORIES BOX FOR CASKETS

CROSS-REFERENCE TO RELATED APPLICATIONS

This application claims priority to U.S. Provisional Patent Application No. 62/092,490 filed on Dec. 16, 2014.

STATEMENT REGARDING FEDERALLY SPONSORED RESEARCH OR DEVELOPMENT

The present invention was not developed with the use of any Federal Funds, but was developed independently by the inventor.

BACKGROUND

1. Field

The present invention relates generally to the field of display cases and more particularly to a receptacle specially designed for housing the flowers, as well as other mementos, that are typically placed on top of a coffin for memorials and funeral services to provide a more secure means of holding flowers in place, along with a tangible keepsake that commemorates the life of the lost loved one.

2. Background

However unfortunate or ironic as it may seem, a guarantee of death is the one thing in life that all people hold in common. Whether a result of a long-term illness or a sudden and unexpected passing caused by an accident, death eventually will find us all. The most typical reaction to the death of a loved one is to celebrate and honor the life of the departed, via a wake or a funeral. Allowing family members to gather, friends to reminisce, and providing an outlet for people to express their love and fond memories of the departed, funerals and memorial services offer a sense of closure for those loved ones who are left behind.

When a loved one is lost, many want to do something or create something to honor the deceased, something that commemorates and memorializes them with dignity, style, love, and the tribute they deserve. The act of planting a tree, creating a special place for meditation, designing a scrapbook, constructing an online tribute page, or tending a garden in memory of someone who has died can be a source of comfort and healing for those left behind. Many psychologists and grief counselors readily agree that a human being's capacity to remember is one of the best things they can do in connection with death and grief. To create a special spot or a concrete emblem to remember somebody is perhaps one of the healthiest things to do to heal the heart and soul after a loss.

Thus, a need exists for a reliable Sentimental Memories Box for Caskets, a receptacle specially designed for housing the flowers, as well as other mementos, that are typically placed on top of a coffin for memorials and funeral services to provide a more secure means of holding flowers in place, along with a tangible keepsake that commemorates the life of the lost loved one and to avoid the above-mentioned problems.

SUMMARY

A display case for holding mementos having a pair of opposed ends, a pair of opposed sides, a bottom, and a top which defines the display case and forms an interior space within for holding the mementos, the top having an opening therein to permit access to the interior space. A cover is provided for selectively closing the top opening of the case. The bottom of the display case is configured to have a central indentation for accommodating an apex of a lid of a casket, a pair of rounded feet on each side of the indentation for providing a sturdy base upon which the display case sits on the lid, and a pair of stabilizing fins extending outwardly and downwardly to each side of the bottom of the display case to stabilize the display case on a curved or inclined top surface of the lid of the casket.

In one form of the invention, the cover slides within a frame provided on the top of the display case to extend between an open position which provided access to the interior of the display case and a closed position which prevents access to the interior of the display case.

A lock may be provided on the frame to secure the cover in the closed position.

In another form of the invention, the sides are defined by side walls and the stabilizing fins extend a length of the opposed side walls;

In yet another form the indentation has a planar horizontal surface which defines the indentation between the rounded feet, and wherein the rounded feet extend the length of the bottom wall of the display case and the stabilizing fins extend lower than the rounded feet to stabilize the display case on an inclined or convex surface.

In view of the foregoing disadvantages inherent in the known display case device art, the present invention provides a novel Sentimental Memories Box for Caskets. The general purpose of the present invention, which will be described subsequently in greater detail, is to provide a receptacle specially designed for housing the flowers, as well as other mementos, that are typically placed on top of a coffin for memorials and funeral services to provide a more secure means of holding flowers in place, along with a tangible keepsake that commemorates the life of the lost loved one. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The embodiments will be described in detail with reference to the following drawings in which like reference numerals refer to like elements wherein.

DETAILED DESCRIPTION

Figure 1:
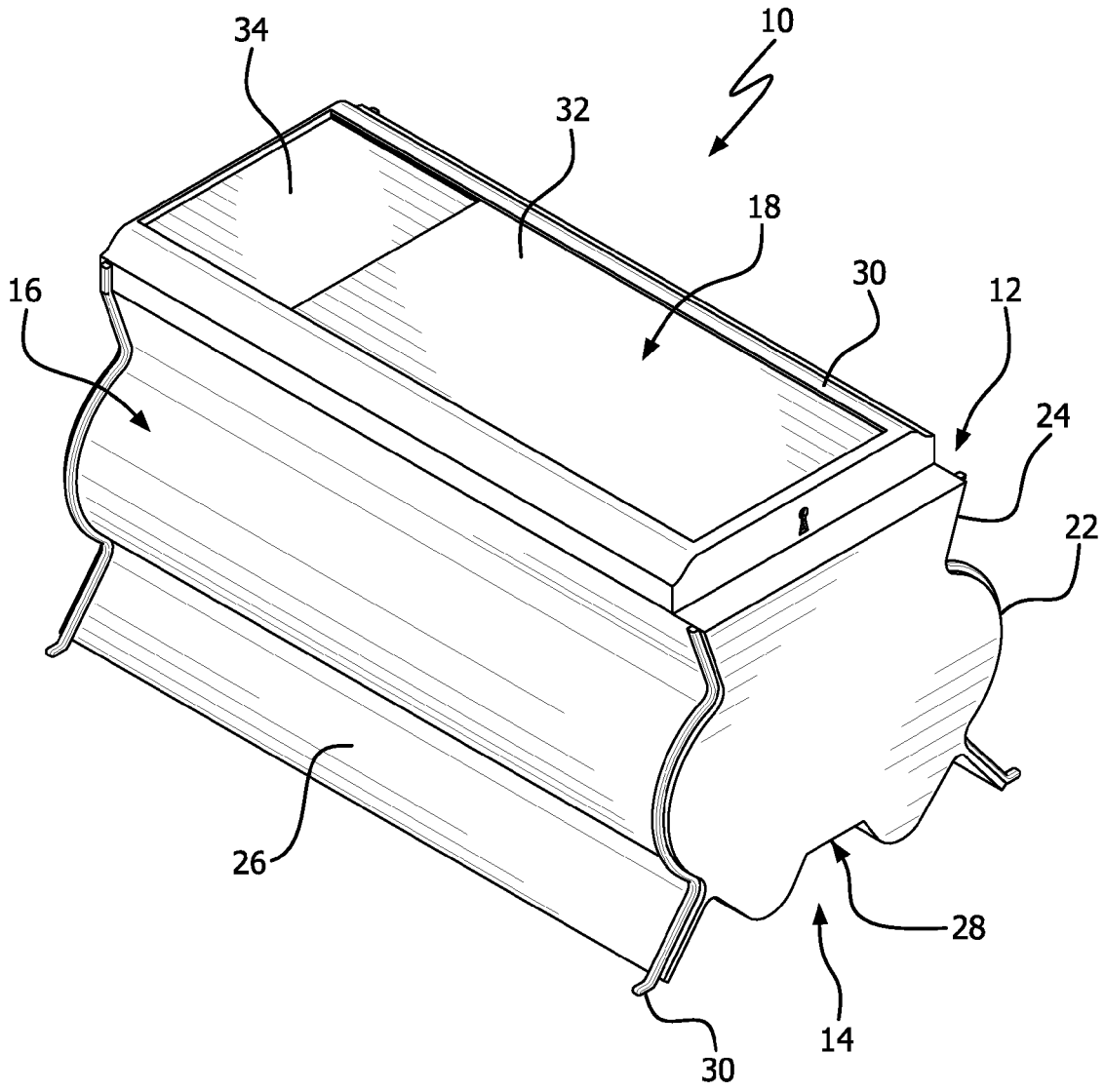
FIG. 1 is an isometric view of a display receptacle for caskets in accordance with the present invention.

Referring now to the Drawing, FIGS. 1 through 5, there is shown a display case 10. As discussed above, embodiments of the present invention relate to the display case device and more particularly to a Sentimental Memories Box for Caskets, a receptacle specially designed for housing the flowers, as well as other mementos, that are typically placed on top of a coffin for memorials and funeral services to provide a more secure means of holding flowers in place, along with a tangible keepsake that commemorates the life of the lost loved one.

Figure 2:
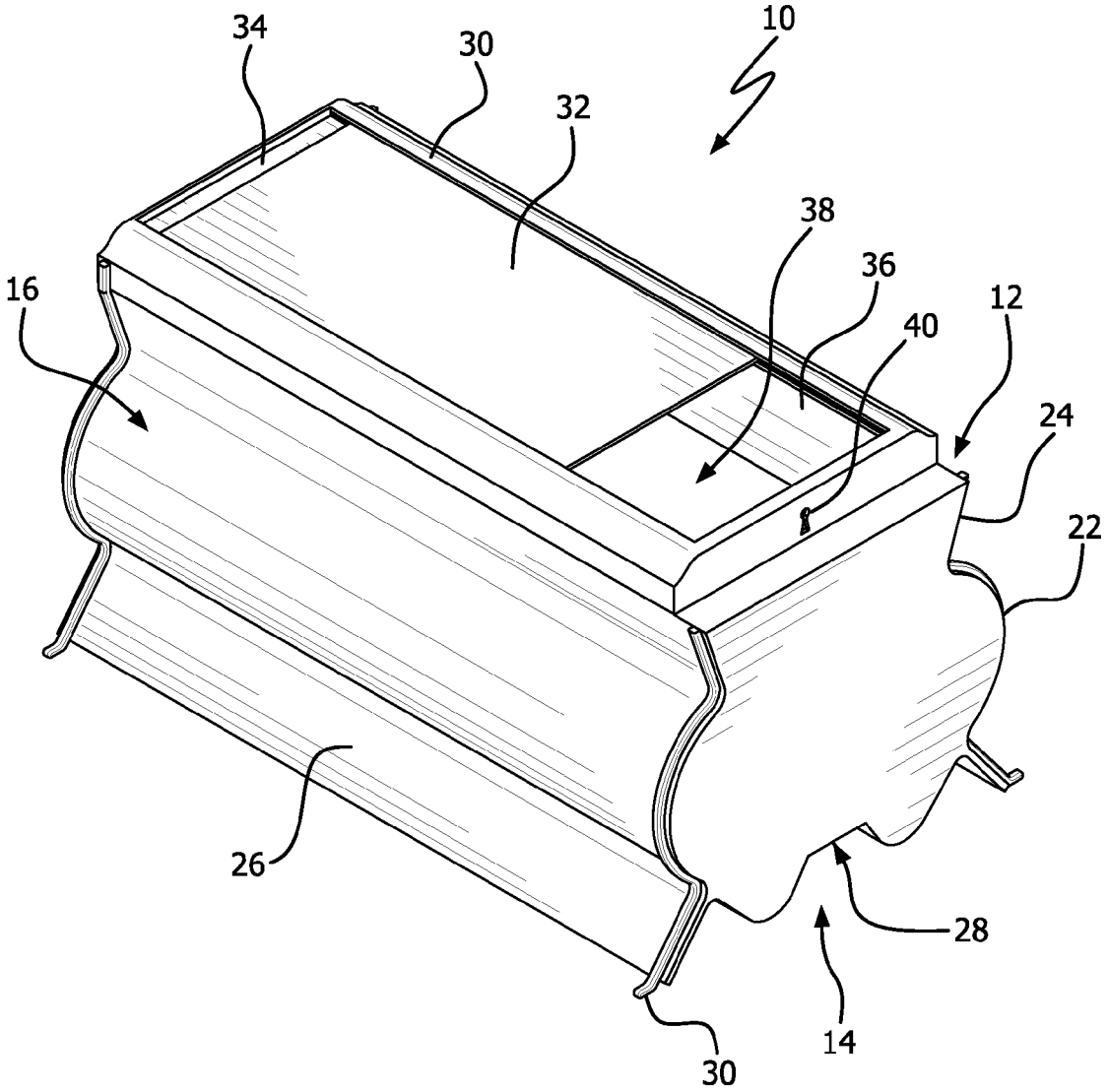
FIG. 2 is an isometric view of the display receptacle of FIG. 1 in an open position.

Referring now to the drawings FIG. 1, the Sentimental Memories Box for Caskets 10 comprises a novel product offering consumers a practical solution to the aforementioned challenges. As the name implies, the Sentimental Memories Box for Caskets comprises a specially designed display case 10 having a top 12, a pair of opposing ends 14, a pair of opposing sides 16, and a bottom 28. As best seen in FIG. 2, the top 12, ends 14, sides, and bottom form and define an enclosed space 38 within the display case 10 to form a receptacle.

Figure 3:
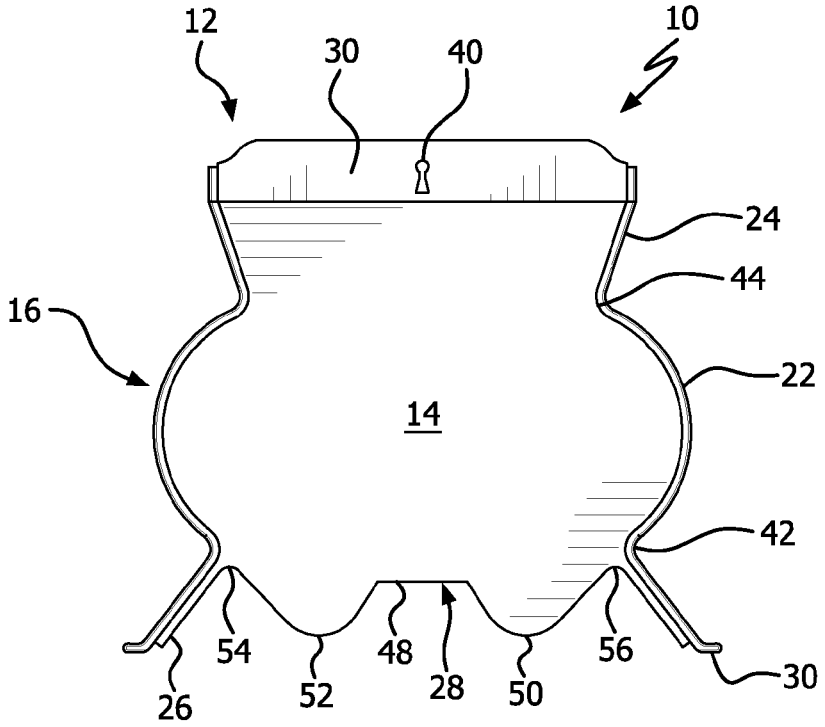
FIG. 3 is a front elevational view of the display receptacle of FIG. 1.

The opposing ends 14 and sides 16 preferably comprise walls. The end walls 14 and side walls 16 preferably have an ornamental appearance as described in greater detail below. In the embodiment shown, the end walls and side walls 16 define a central convex portion 22. Above the convex portion 22, a top sidewall portion 24 extends upwardly and outwardly as best seen in FIGS. 1-3. Below the convex portion 22, bottom sidewall portions 50 and 52 extend inwardly and downwardly from the apex of the convex portions 22 and terminate and define a base upon which the display case 10 sits during use. These bases define feet upon which the display case may sit during use.

Inflection lines 44 and 42 run the length of the side wall 16 and define the intersection between the top sidewall 24 and the convex portion 22 and the outwardly jutting leg 30 and the convex portion, respectively.

Referring now to FIG. 3, the bottom 28 comprises a flat central portion 48 located between the pair of downwardly extending feet 50 and 52.

Intermediately disposed on the bottom sidewall portions 50 and 52 are outwardly extending walls 26 which form stabilizing feet. Decorative piping 30 may also be provided at the joining edges of the side and end walls 16 and 14, respectively. The outwardly and downwardly extending walls 26 meet at inflection lines 54 and 56 which extend the length of the display casket.

Figure 4:
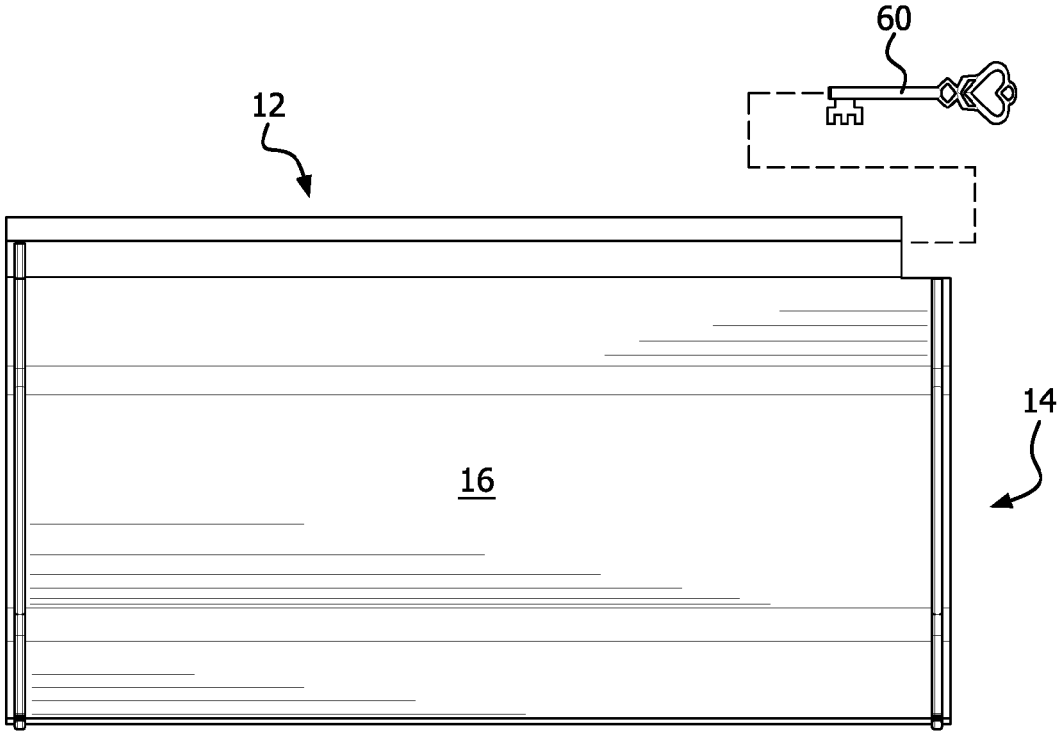
FIG. 4 is a side elevational view of the display receptacle of FIG. 1.

Turning now to FIGS. 1, 3, and 4, there is shown the top 12 which typically comprises a generally planar top wall extending around the periphery of the of the display case 10 and forming a centrally disposed opening 38 into the interior of the display case 10.

Disposed on the top 12 is a frame 30 having a shape that is complementary to the shape of the top 12 of the case 10. In the embodiment shown, the shape of the top 12 and the frame 30 is generally rectangular, but it should be understood that the top can be of any suitable shape.

Similarly, the sides 16, the ends 14 and the bottom 28 may be of any suitable shape to define the ornamental appearance of the display case 10 and to permit the required functionality of the various functional elements, such as walls 26, 28, 50, 52, and the like.

Turning back to the top 12 of the display case 10, the frame 30 includes a lower wall 34 and an upper wall 32. The upper wall 32 preferably slides within channels formed on the edges of the frames to form a slidable cover 32 that extends between an open position (shown in FIG. 2) and a closed position (Shown in FIG. 1).

In the open position shown in FIG. 2, the slidable cover 32 exposes an opening 38 into the interior of the display case 10 near one end 36 of the display case 10. As should be readily understood, the bottom wall 34 has an opening formed therein adjacent end 36 as best seen in FIG. 2. It should also be understood that other suitable covers are contemplated and fall within the scope of the present invention, such as pivoting covers, removable covers, telescoping covers and the like.

Preferably a lock 40 is provided on the frame 30 to secure the cover 32 in the closed position of FIG. 1. Turning now to FIG. 4, a key 60 is also provided which coacts with the lock 40 to secure the cover 32 in the closed position.

Figure 5:
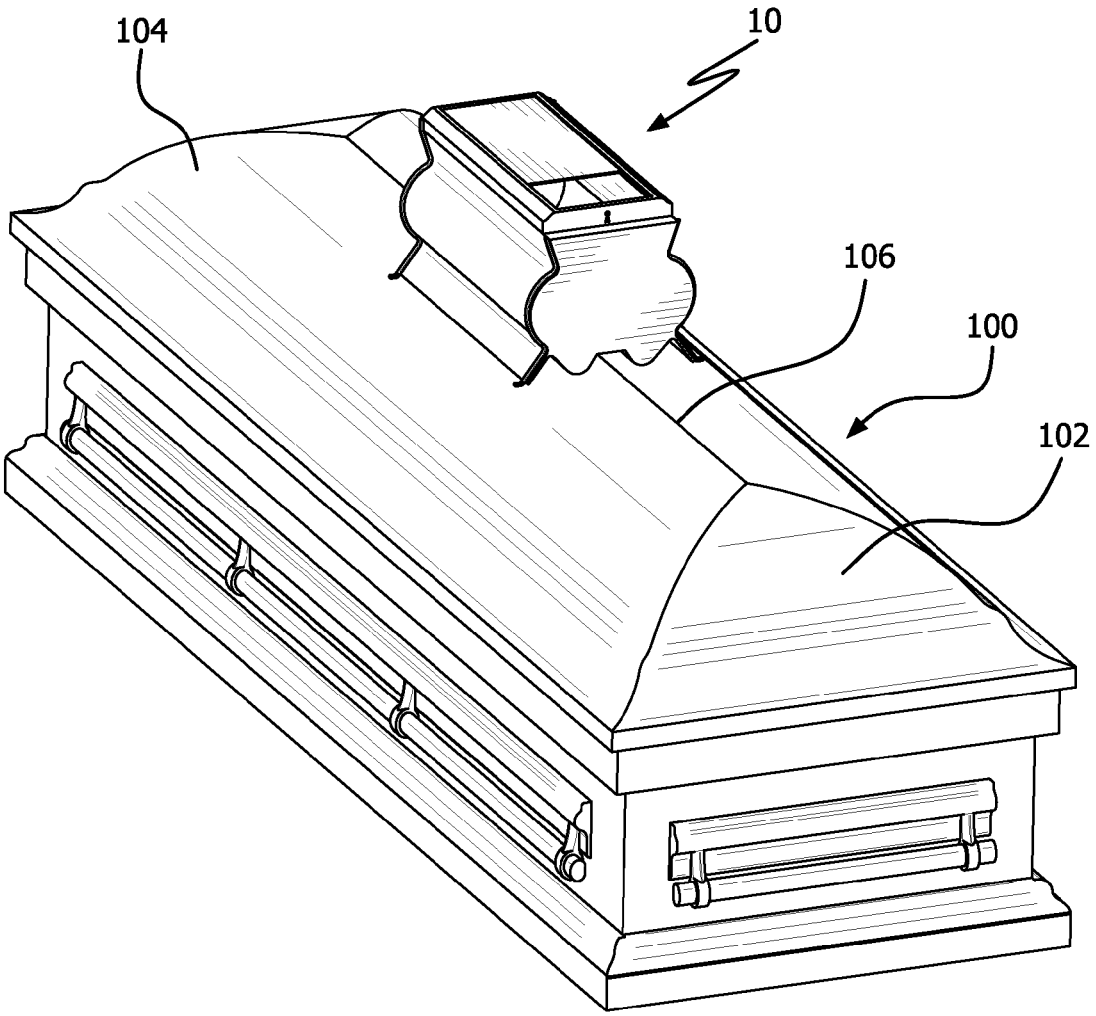
FIG. 5 is an isometric view of the display receptacle of FIG. 1 shown in use on a casket.

Turning now to FIG. 5, the display case is shown in use atop a casket 100. The casket typically includes a top having curved opposed top end surfaces 102 and curved side surfaces 104 which meet at a longitudinally extending apex axis 106 which forms the top of the casket. The irregularly shaped top surface of the casket makes it difficult for objects to be placed atop the casket 100. For this reason the cut out portion defined between the bottom feet 52 and 50 and central bottom wall 48 (best seen in FIG. 3) are provided to accommodate the upwardly extending apex 106 of the top of the casket. The large rounded feet 50 and 52 also serve to accommodate the curved surface 104 of the casket 100. Similarly, the outwardly extending walls 26 serve as stabilizing fins to also keep the display case 10 in a generally horizontal position atop the irregular top surface of most caskets. It should also be noted that the configuration of the feet 50 and 52 along with fins 26 also function to provide a stabilized base on generally planar horizontal surfaces as well.

As best seen in FIG. 5, the display case 10 is configured to be placed atop a casket 100 and is able to house chosen mementos of the decedent, as described in detail below. Moreover, the Sentimental Memories Box for Caskets would serve as a more secure holder for loose flowers placed on top of coffins as well as the funeral sprays that typically adorn the tops of caskets.

The display case 10 is preferably a durably constructed, generally rectangular yet elegantly shaped container, sized appropriately (various sizes) to rest atop a casket to hold and collect mementos and flowers. Lending an air of reverence and elegance, silver or gold trim, or plating (such as piping 30) would adorn the Sentimental Memories Box for Caskets. In addition, Victorian style embellishments would be featured inside and out for high quality presentation. Appropriately, the base and legs of the box would be built to accommodate the curvature of the standard casket top. This base could also boast adjustable legs, and likely suction cups, or rubber gripping feet to facilitate secure placement. The Sentimental Memories Box for Caskets would be accessed via a lockable sliding door, or the like.

The interior 38 of the case 10 is preferably lined with a soft velvet material. Here is where items such as photographs, notes, roses, and other tributes to the decedent would be placed. Because loosely placed flowers (and other items) on top of coffins tend to easily fall away, this invention would be able to hold a copious amount of flowers within its confines, keeping them in place, as to not upset attendees. Should the family wish the Sentimental Memories Box for Caskets to be interred with the decedent, the secured case would be able to be easily lowered into the ground on the casket, with its contents, the flowers, and any other items placed within steadfastly intact. As this product is also designed as a keepsake, the unit, or unit top can be embossed or engraved according to preference of the family, and presented to them following the burial. Alternately, the decorative key which locks and unlocks the sliding door could be presented to the family as the keepsake.

Attractive and distinct, the Sentimental Memories Box for Caskets would provide a tangible memory of a beloved friend or family member, offering a beautiful acknowledgment for a life well lived. In this manner, the product would allow grieving consumers to find an inspirational outlet for dealing with, and healing from, their loss. Another advantage is that through the Sentimental Memories Box for Caskets, users could create customized, lasting keepsakes for future generations.

Passed down to children and grandchildren, a souvenir Sentimental Memories Box for Caskets engraved cover or treasured key would offer a lasting memento and treasured heirloom to be viewed and talked about for years to come, preserving family history and serving as a visual reminder of the person's accomplishments in life. Practical and versatile, this useful product overall would hold the sentimental items placed within dearly, and close to the family member or loved one. With this is mind, the Sentimental Memories Box for Caskets should be well received by funeral directors and their clientele.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display case for holding mementos, comprising:

a pair of opposed ends, a pair of opposed sides, a bottom, and a top which defines the display case and forms an interior space within for holding the mementos, the top having an opening therein to permit access to the interior space;

a cover for selectively closing the top opening of the case; and the bottom of the display case having a central indentation formed therein adapted to accommodate an apex of a lid of a casket, a pair of rounded feet on each side of the indentation adapted to provide a sturdy base upon which the display case sits on the lid, and a pair of stabilizing fins extending outwardly and downwardly to each side of the bottom of the display case adapted to stabilize the display case on a curved or inclined top surface of the lid of the casket.

2. The display case of claim 1 wherein the cover slides within a frame provided on the top of the display case to extend between an open position which provided access to the interior of the display case and a closed position which prevents access to the interior of the display case.

3. The display case of claim 2 wherein a lock is provided on the frame to secure the cover in the closed position.

4. The display case of claim 1 wherein the sides are defined by side walls and the stabilizing fins extend a length of the opposed side walls.

5. The display case of claim 4 wherein the indentation has a planar horizontal surface which defines the indentation between the rounded feet.

6. The display case of claim 5 wherein the rounded feet extend the length of the bottom wall of the display case.

7. The display case of claim 6 wherein the stabilizing fins extend lower than the rounded feet to stabilize the display case on the curved or inclined top surface.

8. The display case of claim 1 wherein the cover slides within a frame provided on the top of the display case to extend between an open position which provided access to the interior of the display case and a closed position which prevents access to the interior of the display case;

a lock is provided on the frame to secure the cover in the closed position;

the sides are defined by side walls and the stabilizing fins extend a length of the opposed side walls;

the indentation has a planar horizontal surface which defines the indentation between the rounded feet, and wherein the rounded feet extend the length of the bottom wall of the display case and the stabilizing fins extend lower than the rounded feet to stabilize the display case on the curved or inclined top surface.

9. A display case for holding mementos and a casket having a lid, comprising:

the display case having a pair of opposed ends, a pair of opposed sides, a bottom, and a top which defines the display case and forms an interior space within for holding the mementos, the top having an opening therein to permit access to the interior space;

a cover for selectively closing the top opening of the case;

the casket having a top lid having a top inclined or convexly curved surface; and the bottom of the display case having a central indentation formed therein for accommodating an apex of the lid of the casket, a pair of rounded feet on each side of the indentation for providing a sturdy base upon which the display case sits on the lid, and a pair of stabilizing fins extending outwardly and downwardly to each side of the bottom of the display case to stabilize the display case on the curved or inclined top surface of the lid of the casket.

10. The display case and casket of claim 9 wherein the cover slides within a frame provided on the top of the display case to extend between an open position which provided access to the interior of the display case and a closed position which prevents access to the interior of the display case.

11. The display case and casket of claim 10 wherein a lock is provided on the frame to secure the cover in the closed position.

12. The display case and casket of claim 9 wherein the sides are defined by side walls and the stabilizing fins extend a length of the opposed side walls.

13. The display case and casket of claim 12 wherein the indentation has a planar horizontal surface which defines the indentation between the rounded feet.

14. The display case and casket of claim 13 wherein the rounded feet extend the length of the bottom wall of the display case.

15. The display case and casket of claim 14 wherein the stabilizing fins extend lower than the rounded feet to stabilize the display case on the top inclined or convexly curved surface.

16. The display case and casket of claim 9 wherein the cover slides within a frame provided on the top of the display case to extend between an open position which provided access to the interior of the display case and a closed position which prevents access to the interior of the display case;

a lock is provided on the frame to secure the cover in the closed position;

the sides are defined by side walls and the stabilizing fins extend a length of the opposed side walls;

the indentation has a planar horizontal surface which defines the indentation between the rounded feet, and wherein the rounded feet extend the length of the bottom wall of the display case and the stabilizing fins extend lower than the rounded feet to stabilize the display case on the top inclined or convexly curved surface.

* * * * *